United States Patent [19]

Finstad et al.

[11] Patent Number: 4,943,040

[45] Date of Patent: Jul. 24, 1990

[54] ADJUSTABLE WORK STAND

[75] Inventors: Clem B. Finstad, Red Wing; Howard J. Fredrickson, Cannon Falls, both of Minn.

[73] Assignee: Cannon Equipment Company, Cannon Falls, Minn.

[21] Appl. No.: 301,682

[22] Filed: Jan. 26, 1989

[51] Int. Cl.[5] ..... B25B 1/02

[52] U.S. Cl. ..... 269/69; 108/6

[58] Field of Search ..... 108/121, 124, 129, 1, 108/6, 132, 131; 182/181; 269/139, 69, 71, 90

[56] References Cited

U.S. PATENT DOCUMENTS 3,641,946 2/1972 Charnay ..... 108/6

4,095,778 6/1978 Wing ..... 269/139

4,144,822 3/1979 Roberts et al. ..... 108/125

4,150,733 4/1979 Plummer ..... 108/121

*Primary Examiner*—Robert C. Watson

*Attorney, Agent, or Firm*—Henry C. Kovar

[57] ABSTRACT

An adjustable work stand has fixed and hinged legs connected to a leg bracket, a table having a table bracket connected to a fulcrum in the leg bracket and fixed leg, a lock bolt in the hinged leg indexes both legs and the tables in several configurations including a plurality of table angles and a collapsed storage configuration, and a single actuator operates the lock bolts for any and all adjustments of the work stand and its mechanism.

25 Claims, 3 Drawing Sheets

ADJUSTABLE WORK STAND

BACKGROUND OF THE INVENTION

1. Field of the Invention

This invention pertains to an adjustable work stand having a multiple position table and a construction which collapses, with a lock mechanism requiring the use of only one hand for release and/or lock of the table and for release and/or lock of the legs. The work stand is particularly well suited for body shop repair of vehicle panels.

2. The Prior Art

Adjustable work stands are old and well known. They are also quite usable for repair and refinishing of vehicle panels such as fenders, doors, tailgates and the like.

Specific examples of these work stands are the subject of the following U.S. Pat. Nos.:

2904087: K. H. WALTHAU
4268020: A. E. WOOD
4501202: H. CORAZZA
4530492: R. L. BORK
4538796: G. L. STECK
4577843: D. R. MILWAIN
4676491: G. RADLOF

One of the major problems with these prior work stands is that they are difficult to operate and have several actuators and lock and adjusters.

Simplification of the adjustment mechanisms and operation is needed.

OBJECTS OF THE INVENTION

It is an object of this invention to provide a new work stand having adjustability and collapsibility by a single actuator.

It is an object of this invention to provide a new adjustable mechanism for the table and legs of a work stand.

It is an object of this invention to provide a work stand with a single lock mechanism for both table adjustment and leg adjustment.

SUMMARY OF THE INVENTION

An adjustable work stand has a fixed leg, a hinged leg, a leg bracket connected to both legs, a work table, a work table bracket connected by a fulcrum to the leg bracket, and a lock bolt engaging and locking together the hinged leg, leg bracket, a table bracket and therefore both legs and the table.

An adjustable work stand has pairs of fixed and hinged legs connected to a respective pair of leg brackets, a work table with a pair of table brackets mounted rotatably with respect to the legs, a transversely movable lock bolt in each hinged leg, and at least two lock abutments in each bracket that are engagable with a respective lock bolt.

An adjustable work stand has a pair of legs connected to each other by a hinge, a leg bracket, an adjustable position table atop of the legs, a table bracket fixed to and co-movable with the table, a lock bolt for engaging both the legs, leg bracket and table bracket, and a lock operator that will both lock and/or release the table and lock and/or release the legs.

A work stand mechanism has a leg bracket for first and second legs, a table bracket, a table fulcrum pin, a second leg portion, and a single lock bolt in the leg portion for locking the leg portion, the leg bracket and the table bracket together and providing adjustment of the table bracket to a different position.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

DESCRIPTION OF THE PREFERRED EMBODIMENT

Figure 1:
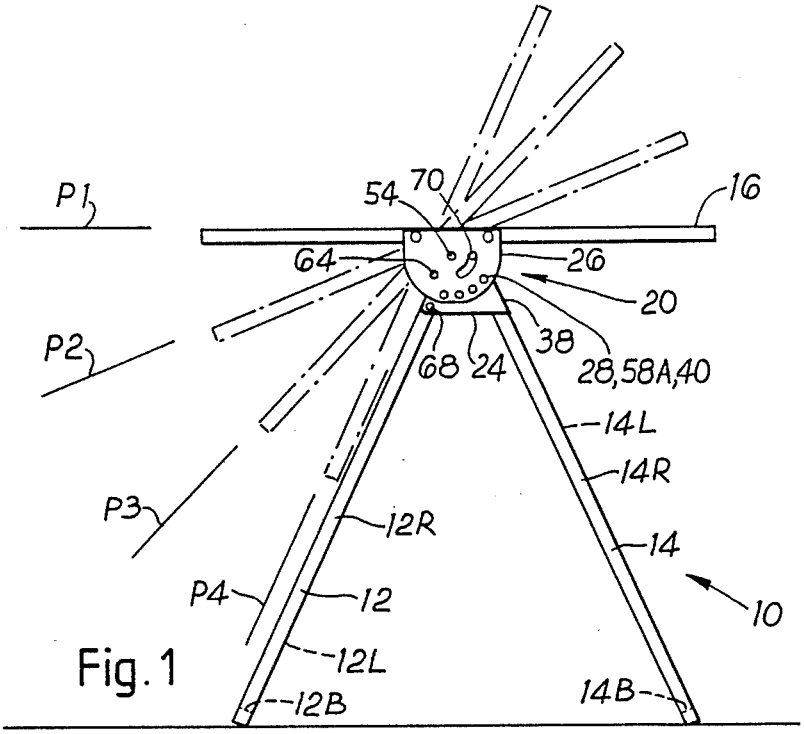
FIG. 1 is a side elevational view of the work stand of the present invention.
Figure 2:
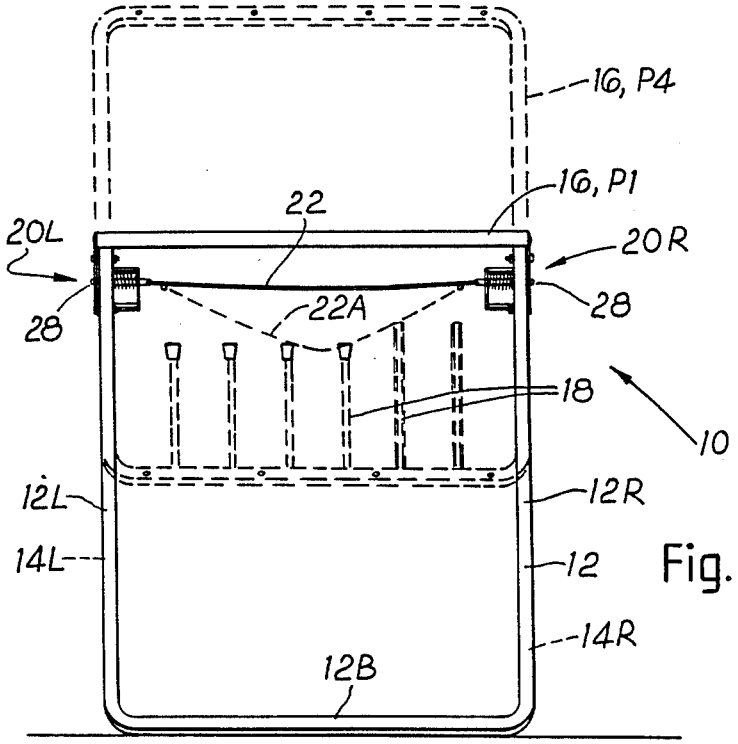
FIG. 2 is an end elevational view of the structure of FIG. 1.

In accordance with the principles of the present invention, a work stand is provided as shown in FIGS. 1 & 2 and as generally indicated by the numeral 10. The work stand 10 includes a first and relatively fixed leg 12, a second and relatively movable hinged leg 14, an adjustable work and/or load supporting table 16 which is shown in solid line in a normal horizontal altitude P1, but which is easily adjustable to any of alternative altitudes P2, P3, P4 as will be explained. A table and leg mechanism, generally indicated by the numeral 20, interconnects and fixes the positions of the legs 12, 14, and table 16 with respect to one another.

The table 16 is preferably a closed rectangular frame of square tubing upon which an appropriate table top (not shown) or work holders 18 can be mounted. Each of the legs 12, 14 is preferably a generally U-shaped member having right legs 12R, 14R and left legs 12L, 14L which are structurally interconnected by leg bases 12B, 14B. There is a complete right mechanism 20R and a complete mirror image left mechanism 20L. Both mechanisms are controlled by a single common actuator 22.

The most important part of this invention is the new mechanism 20 which enables adjustment of both the table 16 and the legs 12, 14 with one hand on the actuator 22 and the other hand on the table 16 or table load as the case may be. The mechanism 20 includes a leg bracket 24, a table bracket 26, and a lock bolt 28 which is connected to the common actuator 22.

Figure 3:
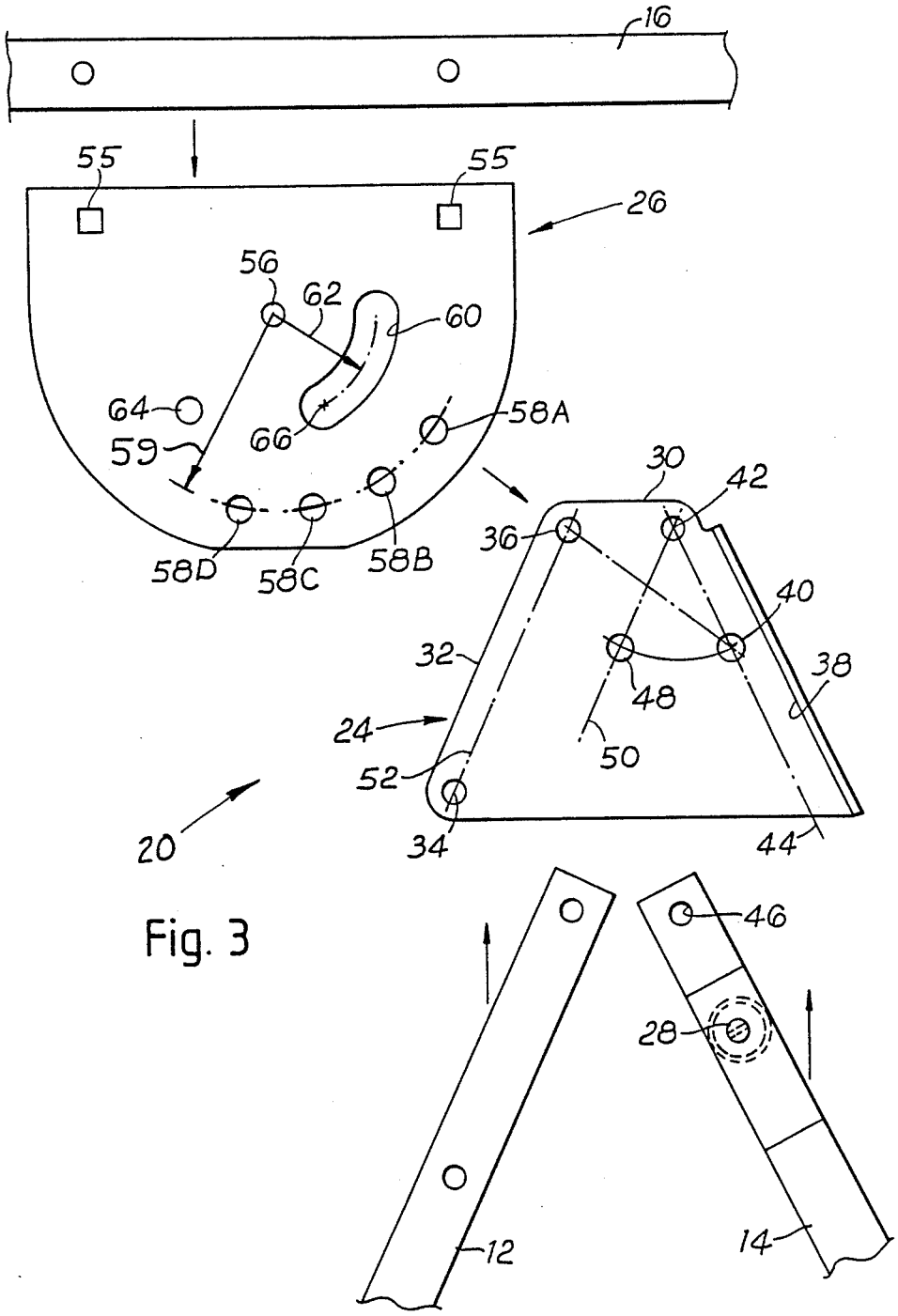
FIG. 3 is an exploded side elevational view of the structure of FIG. 1.

As best shown in FIG. 3, the leg bracket 24 is a generally triangular shaped bracket having a truncated top 30. Along a flat fixed edge 32 are a pair of apertures 34, 36. Along a formed opposite edge is an outstop 38 formed by an inward extending flange. Adjacent the outstop 38 is a second pair of apertures 40, 42 which lie in a line 44 parallel to and spaced from the outstop 38. Apertures 40, 42 are closer together than the apertures 34, 36. Aperture 42 is the fulcrum aperture for the hinged leg 14 which has a top journal 46 which is bolted to aperture 42 to form the hinge joint between the leg bracket 24 and the hinged leg 14. Aperture 40 is a leg lock aperture for locking of the hinged leg 14 in a spread position for stable support and use of the work stand 10, as shown in FIG. 1. A leg storage lock aperture 48 is centrally located in the leg bracket 24. The storage lock aperture is located equivalent and on the same radius from the leg fulcrum aperture 42 as the leg lock aperture 40.

A line 50 drawn through apertures 42, 48 is parallel to a line 52 drawn through apertures 34, 36. Aperture 36 is the aperture for a combination table fulcrum pin and fixed leg bolt 54.

The table bracket 26 has a pair of fastener apertures 54 for fastening to the table 16. A table journal aperture 56 is centrally located in the bracket 26. A plurality of table position lock apertures 58A,B,C,d are located on a radius swing from the center-line of the journal aperture 56. The radius length is identical to the spacing between apertures 36 and 40 on the leg bracket 24. An arcuate slot 60 is located on a radius 62 which is identical to the spacing between apertures 36 and 42. A table storage lock aperture 64 is located from journal a56 a distance identical to the distance between apertures 36 and 48; the storage lock aperture 64 is located from end radius point 66 in slot 60 a distance identical to the spacing between apertures 42 and 48 on the leg bracket 24.

Figure 4:
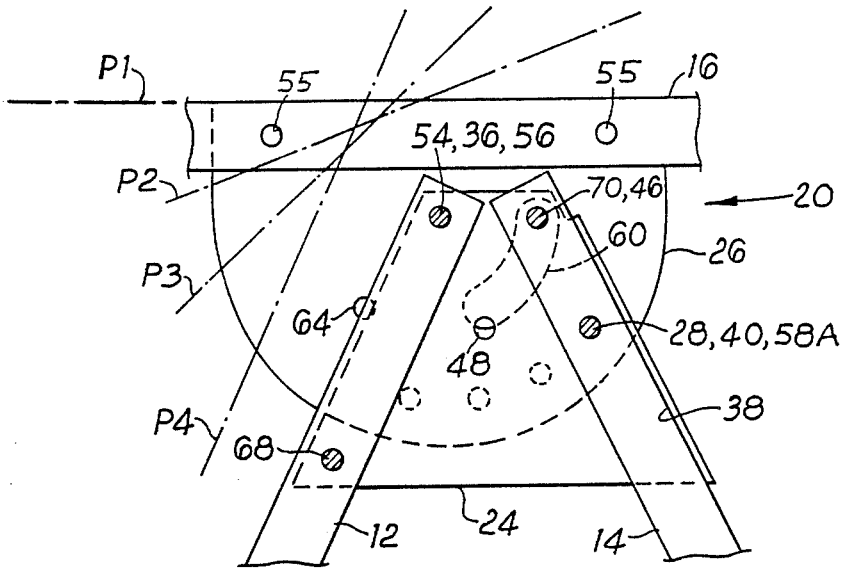
FIG. 4 is a side elevational view of the workings and geometry of the structure of FIG. 1.

FIG. 4 best illustrates the operation and interrelating geometries of the work stand 10 and the mechanism 20. The work stand 10 is shown with the table fulcrum bolt 54 providing the hinge for the table 16, and a second bolt 68 providing with bolt 54, the fixed securement of the fixed leg 12 to the leg bracket 24. The hinged leg 14 is mounted on a leg fulcrum bolt 70 and the lock bolt 28 is registered with and is extending through lock apertures 40 and 58A with the table 16 rigidly positioned in P1. The hinged leg 14 is abutted against the outstop 38. By pulling actuator 22 with one hand, lock bolts 28 will be pulled inward out of lock apertures 58A and the table 16 can be moved independently of the legs from P1 to P2 wherein aperture 58B will register with lock bolt 28, and so on for positions P3 and P4. When the table 16 reaches either position P1 or P4, the ends of the arcuate slot 60 abut against the outer head of the leg fulcrum bolt and limit rotation of the table 16.

Figure 5:
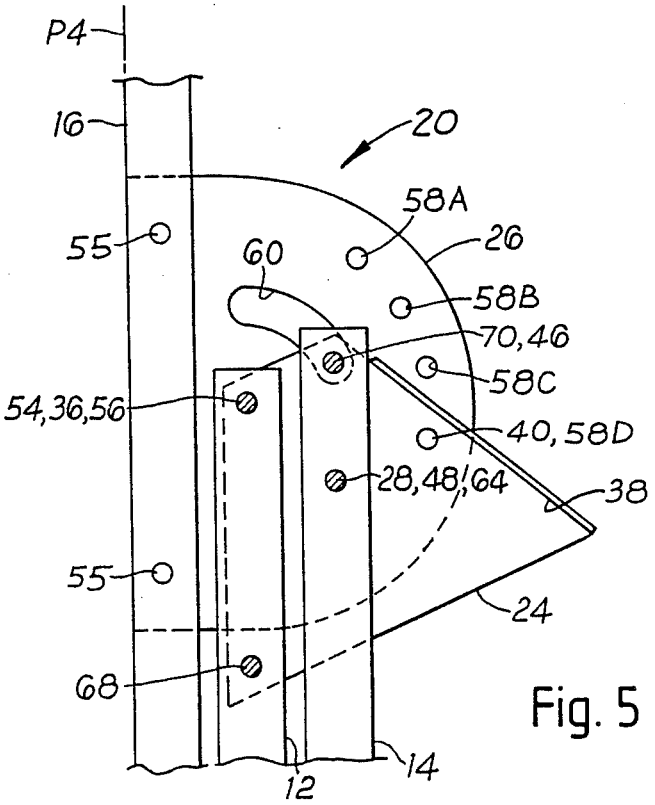
FIG. 5 is a side elevational view of the structure of FIG. 4 in an alternative storage configuration.

FIG. 5 shows the work stand 10 and mechanism 20 is an alternative storage position. The table 16, and hinged leg 14 are both parallel to the centrally located fixed leg 14. The lock bolt 28 is registered with and is extending through apertures 48 and 64. The leg fulcrum bolt 70 is aligned with end point 66 in the slot 66.

The table 16 and legs 12, 14 can both be adjusted upon one handed operation of the actuator 22 and the spring loaded lock bolts 28. The mechanism 20 and the work stand 10 are very positively held in a selected rigid configuration.

When the workstand 10 and mechanism 20 are deployed in the usable position shown in FIGS. 1 and 2, the legs 12, 14 and leg bracket 24 form a rigid and generally equilateral triangular configuration wherein the legs 12, 14 are spread out and away from each other. The legs 12, 14 are double held on each side of the workstand 10 firstly by the lock bolt 28 and secondly, by the outstop 38. Thus even if the lock bolts 28 are pulled out, the legs 12, 14 are still positively held by the outstops 28 and the workstand 10 remains stable. The table 16 is positively held in any one of positions P1, P2, P3, P4. Position P1 is a horizontal "table" position. Positions P2, P3, and P4 are "easel" positions, and position P4 is also an upright "storage" position when leg 14 is folded in as to the storage position shown in FIG. 5.

The workstand 10 and mechanism 20 hold the table 16 exceptionally rigid. Firstly, the table 16 is positionally locked on both sides, and the mechanical lock is at the fore-aft center of the table 16. The lock loads are then spread to the table frame 16 by the two table brackets 26 and spaced apart table fastener structures 54. Then, loading on the table 16 is directly applied firstly to both leg brackets 24 and then distributed to all four legs 12L, 12R, 14L, 14R rather than just to one leg as in the prior art.

In an alternative embodiment of the workstand 10 and mechanism 20, the arcuate slot 60 is replaced by outwardly formed arcuate pocket that also protectively covers the outward projection of the leg fulcrum bolt 70. While the pocket is not shown, it shares the same size, shape, location and function as the arcuate slot 60.

Although other advantages may be found and realized and various modifications may be suggested by those versed in the art, be understood that we wish to embody within the scope of the patent warranted hereon, all such embodiments as reasonably and properly come within the scope of our contribution to the art.

We claim as our invention:

1. A work stand comprising
(a) a fixed leg;
(b) a hinged leg;
(c) a leg bracket rigidly and non-movably affixed to the fixed leg and connected by a leg fulcrum to the hinged leg;
(d) a work table;
(e) a table bracket affixed to the table and hinged to a table fulcrum, said table fulcrum being fixed with respect to said leg bracket;
(f) a lock bolt engaging the hinged leg, the leg bracket and the table bracket, said lock bolt positionally fixing said table and said legs with respect to each other and in a rigid position of use.

2. The work stand of claim 1, in which said leg fulcrum has means for limiting rotation of said table about said table fulcrum.

3. The work stand of claim 1, including an outstop on said leg bracket for abutting against said hinged leg wherein said hinged leg is in a deployed position for support of the work stand.

4. The work stand of claim 1, in which said leg bracket has a leg lock abutment registrable with and accepting of said lock bolt, and in which said table bracket has at least one table lock abutment registratable with said leg lock abutment and also accepting of said lock bolt.

5. The work stand of claim 4, in which said table bracket has a plurality of spaced apart said table lock abutments.

6. The work stand of claim 5, in which said plurality of table lock abutments are located on a radius swing from the center-line of a bolt fastening the fixed leg to the leg bracket.

7. The work stand of claim 1, including a leg storage lock abutment in said leg bracket, and a table storage lock abutment in said table bracket, said storage lock abutments being registrable with each other and jointly receptive of said lock bolt.

8. The work of claim 7, in which said table and said legs are parallel to one another wherein said lock bolt is in said storage lock abutments.

9. The work stand of claim 8, in which said fixed leg is in-between the table and the hinged leg when said table and said legs are parallel to one another.

10. The work stand of claim 1, in which said leg bracket is a truncated triangular shaped plate, said fulcrums being located on each corner of a truncated apex of the plate.

11. The work stand of claim 1, in which said lock bolt is mounted in and is carried by said hinged leg.

12. The work stand of claim 1, including a single lock bolt actuator for releasing said table and for releasing said hinge leg, from a rigid position.

13. The work stand of claim 1, including
- a pair of spaced apart and interconnected said fixed legs,
- a pair of spaced apart and interconnected said hinged legs,
- a pair of spaced apart said leg brackets,
- a pair of spaced apart said table brackets,
- a pair of said lock bolts, and
- a single actuator for operating said lock bolts and releasing either or both of said table or said hinged legs from the rigid position of use.

14. An adjustable and collapsible work stand comprising
- (a) a pair of spaced apart and interconnected fixed legs;
- (b) a pair of spaced apart and interconnected hinged legs;
- (c) a pair of spaced apart leg brackets, each leg bracket being affixed to a respective one of said fixed legs and being connected by a hinge joint to a respective one of said hinged legs;
- (d) a work table atop of and supported by said legs;
- (d) a pair of table brackets mounted one each to respective side of the table, each table bracket being rotatably mounted with respect to said legs on a table fulcrum fixed with respect to said fixed leg;
- (f) a transversely movable lock bolt in each hinged leg; and
- (g) at least two leg lock abutments in each leg bracket and at least two table lock abutments in each table bracket, said lock abutments all being registrable with and acceptive of a respective said lock bolt.

15. The work stand of claim 14, including single means for moving said lock bolts out of both a respective table bracket abutment and a leg bracket abutment.

16. The work stand of claim 14, in which each said table bracket has clearance means for moving past a respective leg hinge joint.

17. The work stand of claim 14, in which the leg lock abutments are located on a radius swung from the leg hinged joint, and in which one of each pair of said table lock abutments and a third table lock abutment are located on a radius swing from said table fulcrum.

18. The work stand of claim 14, including stop means for aligning either of said leg lock abutments and either of said table lock abutments, with said lock bolt.

19. An adjustable work stand comprising
- (a) a pair of legs connected to each other by a leg hinge adjacent upper ends of said legs, said legs being foldable toward each other to a storage position and openable away from each other to a normal usage position, one of said legs having a lock structure;
- (b) a leg bracket affixed to one of the legs, said leg bracket having a leg lock abutment therein;
- (c) an adjustable position work table atop of the legs, said table being connected to the legs by a table hinge, said table hinge having an axis generally parallel to an axis of the leg hinge;
- (d) a table bracket afixed to and co-movable with said table into a plurality of positions about the table hinge axis, said table bracket having a table lock abutment therein;
- (e) a lock bolt movably mounted in said work stand and simultaneously registrable with said leg lock structure, said leg lock abutment, and said table lock abutment for locking both of said legs and said table into a positionally fixed said normal usage position, and
- (f) lock operator means for firstly operating said lock between said table bracket and said legs for positionally locking and/or releasing said table with respect to said legs, and secondly for operating said lock between said leg lock structure and said leg lock abutment for positionally locking and/or releasing said legs with respect to each other.

20. The work stand of claim 19, including one of
said leg lock structures,
said leg brackets,
said table brackets, and
said lock bolts,
on each side of the work stand, with there being a single and common said lock operator means for operating both said lock bolts.

21. The work stand of claim 19, in which said leg bracket has a first and second said leg lock abutment, and in which said table bracket has a first and second said table lock abutment, said first abutment being jointly registrable with said lock bolt when said work stand is in a normal usage position, and said second abutment being jointly registrable with said lock bolt when the work stand is in the storage position.

22. The work stand of claim 21, including a plurality of spaced apart said first table lock abutments.

23. The work stand of claim 21, in which said second table lock abutment is located on a radius swing from said leg hinge on a loci which is in an aperture radius swing from said table hinge.

24. A work stand mechanism comprising
- (a) a leg bracket having
  - (1) means for fixedly securing a first leg thereto,
  - (2) means for hingedly securing a second leg thereto,
    - (3) means for locking the second leg in a use positon spread from the first leg, and in a storage position adjacent the first leg, and
      - (4) a storage lock abutment spaced from said radius;
- (c) a table fulcrum pin acceptable in the journal and the first leg securing means;
- (d) a second leg portion including a journal connectable to said second leg securing means; and
- (e) a single lock bolt in said second leg portion, said lock bolt being simultaneously registrable with and engagable in one of said leg lock means and any one of said table bracket lock abutments.

25. The mechanism of claim 24, in which said table bracket has a rotational limit stop engagable with said second leg securing means.

* * * * *